US006519426B2

(12) United States Patent
Goto et al.

(10) Patent No.: US 6,519,426 B2
(45) Date of Patent: Feb. 11, 2003

(54) IMAGE HEATING APPARATUS AND IMAGE FORMING APPARATUS HAVING THE IMAGE HEATING APPARATUS

(75) Inventors: Masahiro Goto, Shizuoka (JP); Satoru Izawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 09/854,575

(22) Filed: May 15, 2001

(65) Prior Publication Data

US 2002/0003970 A1 Jan. 10, 2002

(30) Foreign Application Priority Data

May 17, 2000 (JP) ..... 2000-144903

(51) Int. Cl.[7] ..... G03G 15/20; G03G 21/00
(52) U.S. Cl. ..... 399/69; 219/216; 399/88
(58) Field of Search ..... 219/216, 501; 399/43, 45, 69, 88, 320, 330, 328, 331

(56) References Cited

U.S. PATENT DOCUMENTS

| | | | | |
|---|---|---|---|---|
| 5,148,226 A | | 9/1992 | Setoriyama et al. | |
| 5,149,941 A | | 9/1992 | Hirabayashi et al. | 219/216 |
| 5,210,579 A | | 5/1993 | Setoriyama et al. | |
| 5,262,834 A | | 11/1993 | Kusaka et al. | |
| 5,525,775 A | | 6/1996 | Setoriyama et al. | |
| 5,920,757 A | | 7/1999 | Izawa et al. | 399/329 |
| 5,960,233 A | | 9/1999 | Goto et al. | 399/69 |
| 6,111,230 A | * | 8/2000 | Cao et al. | 219/501 |
| 6,298,213 B1 | * | 10/2001 | Miyamoto et al. | 399/320 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-77315 | 3/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |

* cited by examiner

*Primary Examiner*—Hoang Ngo
(74) *Attorney, Agent, or Firm*—Fitzpatrick, Cella, Harper & Scinto

(57) ABSTRACT

An image heating apparatus used in an image forming apparatus includes a heating member fixedly disposed, a heat rotary member that slides while an inner surface of the heating member is in contact with the heating member, and a pressure rotary member that forms a heating member and a nip portion through the heating rotary member, in which a recording material that bears an image is nipped between the heating rotary member and the pressure rotary member at the nip portion and conveyed, and the image on the recording material is heated by heat from the heating member through the heating rotary member. In order to obtain a stable heating property (fixing property) not depending on the kind of paper of a recording material (a smooth paper, a rough paper), the temperature of the heating member or the heating rotary member is detected, and the current to the heating member is controlled so that the detected temperature becomes a target temperature. In this situation, the supply power amount to the heating member is monitored, and the target temperature is corrected on the basis of the monitor result. Also, when the temperature detected by the temperature detecting device is within a given range, the current to the heating member is controlled so that a given power is supplied to the heating member.

20 Claims, 13 Drawing Sheets

IN CASE THAT FIXING MODE IS HIGH MODE

IN CASE THAT FIXING MODE IS NORMAL MODE

IN CASE THAT FIXING MODE IS LOW MODE

IN CASE THAT FIXING MODE IS HIGH MODE (FOR THICK PAPER)

IN CASE THAT FIXING MODE IS NORMAL MODE (FOR THICK PAPER)

IN CASE THAT FIXING MODE IS LOW MODE (FOR THICK PAPER)

IN CASE THAT FIXING MODE IS HIGH MODE

IN CASE THAT FIXING MODE IS NORMAL MODE

IN CASE THAT FIXING MODE IS LOW MODE

IMAGE HEATING APPARATUS AND IMAGE FORMING APPARATUS HAVING THE IMAGE HEATING APPARATUS

BACKGROUND OF THE INVENTION

1. Field of the Invention

The present invention relates to an image heating apparatus that fixes or temporarily fixes an unfixed image formed and born on a recording material through a transfer system or a direction system as a permanent fixed image by heating, or heats an image on a recording material to improve the surface property such as gloss, and an image forming apparatus having the image heating apparatus.

2. Related Background Art

Up to now, many of copying machines, printers and the like using, for example, the electrophotographic system adopt a device of a contact heating type heat roller fixing system which is excellent in safety and an energy saving type film heating system as a heat fixing device (fixing unit) which is the image heating apparatus.

The heat fixing device of the heat roller fixing system i s basically made up of a heat roller (fixing roller) as a heating rotary member and an elastic pressure roller as a pressure rotary member, which is in press contact with the heat roller. The paired rollers are rotated to introduce a recording material (a transfer material sheet, an electrostatic recording paper, an electro fax paper, a printing sheet, etc.) as a heating material on which an unfixed image (hereinafter referred to as "toner image") is formed and borne into a fixing nip portion which is a pressure contact nip portion of the paired rollers and to convey the recording material through the fixing nip portion while nipping the recording material at the fixing nip portion, thereby fixing a toner image on a recording material surface due to a heat from the heating roller and the pressure force of the fixing nip portion as a permanently fixed image.

Also, the heat fixing device of the film heating system has been proposed in, for example, Japanese Patent Application Laid-Open No. 63-313182, Japanese Patent Application Laid-Open Nos. 2-157878, 4-44075 to 4-44083, 4-204980 to 4-204984, and so on. In the device, a heat resistant film (fixing film) which is a heating rotary member is conveyed while it is brought in close contact with a heating member such as a ceramic heater which is fixed by the heating rotary member (elastic pressure roller), and the recording material that bears the toner image is introduced into the fixing nip portion which is a pressure contact nip portion formed by the heating member and the pressure rotary member with the film interposed therebetween and then conveyed together with the film, to thereby fix the toner image on the recording material as a permanent image due to the heat given from the heating member through the film and the pressure force of the fixing nip portion.

The heat fixing device of the film heating system can save an electric power and reduce a wait time (quick start) because a low heating capacity linear heating member such as a ceramic heater can be used as a thin film of a low heating capacity. Also, in the heat fixing device of the film heating system, there have been known, as a film driving method, a method in which a driving roller is disposed on an inner surface of the film, and a method in which the pressure roller is used as the driving roller and the film is driven due to a frictional force between the driving roller and the pressure roller. In recent years, there are frequently employed the pressure roller driving system which is small in the number of parts and low in the costs.

In the above heat fixing device, there has been known that the fixing property of the toner image on the recording material largely depends on the thickness and the surface property of the recording material. In particular, a paper of the type having the rough surface property is remarkably low in the fixing property. This is because the sufficient quantity of heat is not supplied to toner on the recording material since a contact area between the heating member and recording material is reduced within the fixing nip portion.

As a result, to obtain an excellent fixing property even in the paper of the type having the inferior surface property, it is necessary to raise the fixing pressure force or raise the fixing temperature.

However, the method of making the fixing pressure rise is liable to increase the costs of the device because the drive torque of the heat fixing device becomes high. In particular, in the heat fixing device of the film heating system, because the film which is the heating rotary member is slid with respect to the heating member serving as a heat source at the fixing nip portion, thereby being liable to increase the rotary torque, it is difficult to increase the pressure force, and the limit of the total pressure is about 15 kg, and the linear pressure within the fixing nip region is comparatively low. For that reason, in order to improve the fixing property of a paper of the type which is low in the surface property, the fixing temperature must be made to rise.

However, in the case where the fixing temperature is only made high, the excessive quantity of heat is supplied to a thin paper or a paper excellent in the surface property, resulting in such problems that hot offset occurs or the curl degree of the paper becomes large.

Also, in the heat fixing device of the film heating system of the pressure roller driving type, there frequently occurs such a phenomenon that when a thin film high in smoothness passes, in the case where the film absorbs moisture, fixing operation is conducted at the high fixing temperature, a large amount of steam occurs, a steam layer is produced between the pressure roller and the paper, the coefficient of friction of the pressure roller is extremely lowered, a paper conveying force disappears and the paper slips, whereby the paper stops within the fixing nip.

Also, not only the fixing temperature but also the fixing nip width is an important parameter with respect to the adverse phenomenon such as the fixing property of the toner image on the recording material, the curl of the recording material, the hot offset of toner or the slip of the recording material.

In other words, if the fixing nip width is large, even if the fixing temperature is low, the quantity of heat is liable to move to the recording material, thereby being capable of exhibiting the excellent fixing property. Conversely, the phenomenon such as curl, hot offset or slip is liable to occur. The fixing nip width mainly depends on the hardness of the pressure roller and the pressure force of the pressure spring, and the hardness and the pressure force vary to some degree, and the fixing nip width is different in each of the heat fixing devices. For that reason, if the fixing temperature is set taking the variation of the fixing nip width into consideration, it is very difficult to satisfy all of the phenomenon such as the fixing property, curl, hot offset or slip with respect to various papers by only one kind of temperature setting as described above.

In this way, it is difficult to satisfy the optimum fixing conditions for both of the paper of the type rough in the surface property and the paper of the type excellent in the smoothness, and up to now, a user copes with this difficulty by selecting the fixing temperature setting in accordance with the kind of paper. However, it is difficult to set the fixing mode by the parameter which is hardly understood by a user, and therefore it is desirable to automatically set the optimum fixing temperature in accordance with the kind of paper (in particular, the roughness of the surface).

SUMMARY OF THE INVENTION

An object of the present invention is to provide an image heating apparatus and an image forming apparatus having the image heating apparatus which are capable of solving the above technical problems.

In order to achieve the above object, according to the present invention, there is provided an image heating apparatus, comprising:

temperature detecting means for detecting a temperature of a heating member or a heating rotary member;

current control means for controlling current to the heating member so that the temperature detected by the temperature detecting means reaches a target temperature;

power monitoring means for monitoring an electric energy supplied to the heating member, and correcting means for correcting the target temperature on the basis of the monitor result by the power monitoring means.

Preferably, the image heating apparatus further comprises a heating rotary member sliding on an inner surface of the heating member; and a pressure rotary member that forms a nip portion in association with the heating member through the heating rotary member;

characterized in that a recording material that bears an image is nipped and conveyed between the heating rotary member and the pressure rotary member to heat the image on the recording material due to a heat from the heating member through the heating rotary member.

Preferably, the correcting means includes detecting means for detecting the thickness of a transfer material and corrects the target temperature in accordance with the detected thickness.

Preferably, the image heating apparatus further comprises means for setting the target temperature in accordance with the number of continuously passing sheets and intervals of passing sheets or an operation mode set by an operator.

Preferably, the heating rotary member comprises a flexible thin endless film which is 20 to 150 $\mu$m in thickness and has a mold release layer formed on the surface thereof.

Preferably, the power monitoring means monitors the electric energy supplied to the heating member when a leading portion of the recording material is heated.

Preferably, the power monitoring means monitors the electric energy supplied to the heating member in a state where a detected temperature is maintained to about the target temperature.

Preferably, the current control means controls the current to the heating member by a phase angle or wave number so that the temperature detected by the temperature detecting means becomes the target temperature.

According to the present invention, there is provided an image forming apparatus including image forming means for forming an image on a recording material; a heating rotary member which slides while an inner surface of the heating rotary member is in contact with the heating member; and a pressure rotary member that forms a nip portion in association with the heating member through the heating rotary member; in which a recording material that bears an image is nipped and conveyed between the heating rotary member and the pressure rotary member to fix the image on the recording material due to a heat from the heating member through the heating rotary member, the image forming apparatus comprising:

temperature detecting means for detecting a temperature of a heating member or a heating rotary member;

current control means for controlling current to the heating member so that the temperature detected by the temperature detecting means reaches a target temperature;

power monitoring means for monitoring an electric energy supplied to the heating member; and correcting means for correcting the target temperature on the basis of the monitor result by the power monitoring means.

Preferably, the correcting means includes detecting means for detecting the thickness of the recording material and corrects the target temperature in accordance with the detected thickness.

Also, according to the present invention, there is provided an image heating apparatus, comprising:

temperature detecting means for detecting a temperature of a heating member or a heating rotary member; and current control means for controlling the current to the heating member;

characterized in that the current control means has a first current control mode that controls the current to the heating member so that a constant power is supplied to the heating member if the temperature detected by the temperature detecting means is within a given range.

Preferably, the image heating apparatus further comprises a heating rotary member which slides while an inner surface of the heating rotary member is in contact with the heating member; and a pressure rotary member that forms a nip portion in association with the heating member through the heating rotary member; characterized in that a recording material that bears an image is nipped and conveyed between the heating rotary member and the pressure rotary member to heat the image on the recording material due to a heat from the heating member through the heating rotary member.

Preferably, the image heating means includes detecting means for detecting the thickness of the recording material and the current control means controls the current to the heating member in accordance with the detected thickness.

Preferably, the current control means has a second current control mode that controls the current to the heating member so that the temperature detected by the temperature detecting means becomes the target temperature.

Preferably, the image heating apparatus further comprises means for setting the target temperature in accordance with the number of continuously passing sheets and intervals of passing sheets or an operation mode set by an operator.

Preferably, the current control means controls the current to the heating member by a phase angle or wave number.

Preferably, the current control means controls the current to the heating member by changing over from the first current control mode to the second current control mode if the temperature detected by the temperature detecting means in the first current control mode becomes out of the given range.

Preferably, the heating rotary member comprises a flexible thin endless film which is 20 to 150 $\mu$m in thickness and has a mold release layer formed on the surface thereof.

According to the present invention, there is provided an image forming apparatus including image forming means for forming an image on a recording material; a heating rotary member which slides while an inner surface of the heating rotary member is in contact with the heating member; and a pressure rotary member that forms a nip portion in association with the heating member through the heating rotary member; in which a recording material that bears an image is nipped and conveyed between the heating rotary member and the pressure rotary member to fix the image on the recording material due to a heat from the heating member through the heating rotary member, the image forming apparatus comprising:

temperature detecting means for detecting a temperature of a heating member or a heating rotary member; and current control means for controlling current to the heating member;

characterized in that the current control means has a first current control mode that controls the current to the heating member so that a constant power is supplied to the heating member if the temperature detected by the temperature detecting means is within a given range.

Preferably, the current control means further has a second current control mode that controls the current to the heating member so that the temperature detected by the temperature detecting means becomes the target temperature, and controls the current to the heating member by changing over from the first current control mode to the second current control mode if the temperature detected by the temperature detecting means in the first current control mode becomes out of the given range.

According to the present invention, because only a low power is supplied to a recording material of the type which is rough in the surface property if the heating temperature (fixing temperature) is the same, it is possible to automatically control an appropriate temperature in accordance with the surface roughness of the recording material through a method of automatically correcting the target temperature in accordance with the supply energy. As a result, the excellent image heating property (fixing property) can be obtained regardless of the surface property of the recording material.

Also, even in the case where the nip width is different in each of the image heating apparatuses, an apparatus wide in the nip width which makes it easy to supply the power to the recording material can correct the target temperature to a lower value whereas an apparatus narrow in the nip width which makes it difficult to supply the power to the recording material can correct the target temperature to a higher value, and the variation in the image heating property among the apparatuses can be suppressed to the minimum. As a result, a precision in the parts can be degraded to make it possible to reduce the costs of the apparatus.

Further, the optimum temperature can be set in accordance with the thickness of the recording material which is another parameter by which the supply power varies, to thereby making it possible to conduct the temperature control higher in precision.

In addition, even in a state where this control cannot follow a paper that greatly absorbs humidity, a recording material high in printing rate, an extremely thick paper or the like, the image heating property of the level that can be sufficiently satisfied can be obtained.

Preferably, a plurality of target temperature settings can be made by user's setting. As a result, it is possible to provide an image heating apparatus having an appropriate image heating property in accordance with the kind of paper not to be controlled and the environments.

Other further objects, features and advantages of the invention will appear more fully from the following description.

BRIEF DESCRIPTION OF THE DRAWINGS

These and other objects and advantages of this invention will become more fully apparent from the following detailed description taken with the accompanying drawings in which:

FIGS. 3A, 3B and 3C are explanatory diagrams showing the structure of a heating member (heater) in which FIG. 3A shows a front surface, FIG. 3B shows a back surface and FIG. 3C shows a cross-section.

DESCRIPTION OF THE PREFERRED EMBODIMENTS

The invention will be understood more readily with reference to the following examples; however, these examples are intended to illustrate the invention and are not to be construed to limit the scope of the invention.

Now, a description will be given in more detail of preferred embodiments of the present invention with reference to the accompanying drawings.

First Embodiment (1) Example of Image Forming Apparatus

Figure 1:
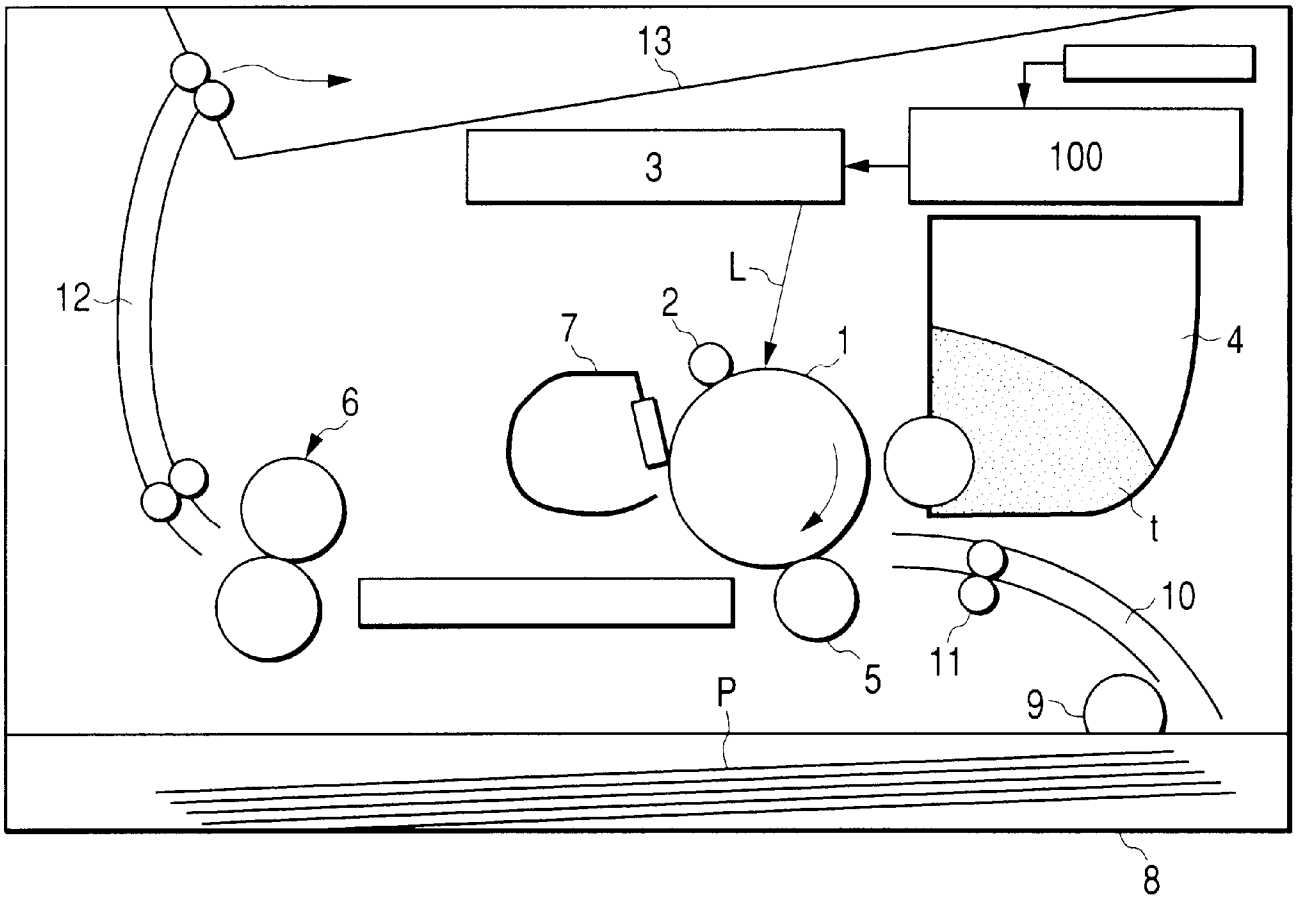
FIG. 1 is a conceptual diagram showing the rough structure of an image forming apparatus in accordance with a first embodiment.

FIG. 1 is a conceptual diagram showing the rough structure of an image forming apparatus in accordance with a first embodiment. The image forming apparatus of this embodiment is a laser beam printer using a transferring electrophotographic process in which the maximum size width is a letter size (216 mm), a printing speed is 20 sheets per minute in case of the letter size, and a recording material (transferring material) feeding speed is 120 mm/sec.

Reference numeral 1 denotes a photosensitive drum as the image bearing member which is structured by forming a photosensitive material such as OPC or amorphous Si on a cylindrical substrate made of aluminum or nickel.

The photosensitive drum 1 is rotationally driven at a given peripheral speed clockwise as indicated by an arrow, and a surface of the photosensitive drum 1 is uniformly charged to given polarity and potential by a charging roller 2 serving as a charging device.

Then, the uniformly charged surface is subjected to scanning exposure L of image information to be printed by the laser beam scanner 3 which is an exposing means, to thereby from an electrostatic latent image on the photosensitive drum 1. The laser beam scanner 3 outputs a laser beam which is on/off controlled in response to a time series electric digital pixel signal of the image information to scan and expose the surface of the photosensitive drum 1 that rotates.

The electrostatic latent image formed on the photosensitive drum 1 surface is developed as a toner image by the developing device 4 so as to be visualized. Reference t denotes a developer (toner) accommodated within the developing device 4. As the developing method, a jumping developing method, a two-component developing method and so on are employed, which are frequently used with the combination of image exposure and reverse development.

The toner image is transferred onto the recording material (hereinafter referred to as "transferring material") P from the photosensitive drum 1 by the transferring roller 5 which is a transferring device. The transferring material P is stacked and accommodated within a sheet feeding cassette 8, from which one sheet is separated and fed due to the actuation of the a sheet feeding roller 9. Then, the sheet passes through a sheet path 10 including a registration roller 11 and is then conveyed and introduced at a transferring portion which is a pressure contact nip portion of the photosensitive drum 1 and the transferring roller 5 at a given control timing.

The transferring material P to which the toner image has been transferred at the transferring portion is conveyed to the heat fixing device 6, and then heated and pressed at a fixing nip portion of the heat fixing device, to thereby fix the toner image on the transferring material as a permanent image.

On the other hand, non-transferred toner that remains after transferring on the photosensitive drum 1 is removed from the surface of the photosensitive drum 1 by a cleaning device 7, and subsequent images are repeatedly formed on the photosensitive drum surface.

The transferring material P going out of the fixing device 6 passes through a sheet path 12 and is then delivered onto a sheet discharge tray 13 as a print.

Reference numeral 100 denotes an engine control portion that controls the image forming apparatus.

(2) Heat Fixing Device 6

Figure 2:
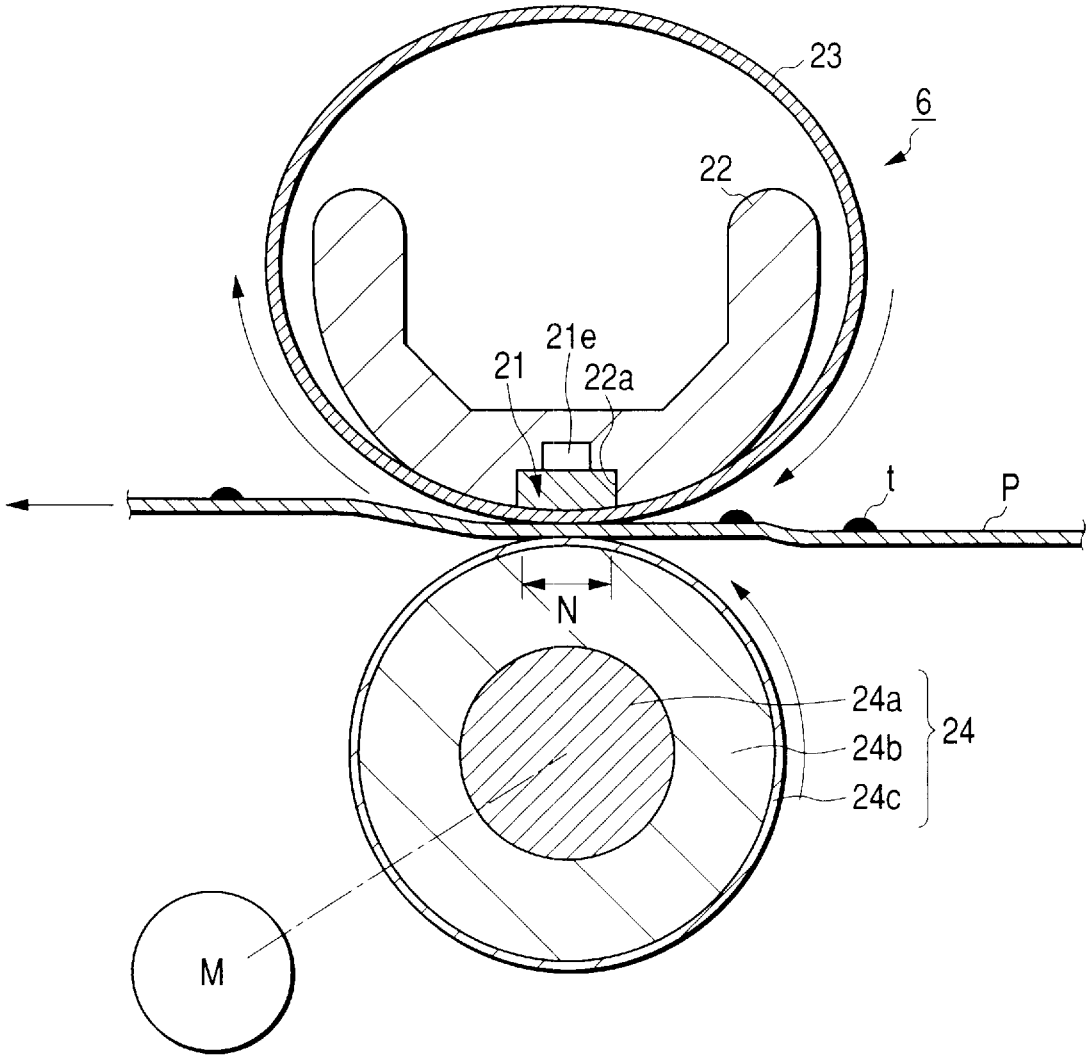
FIG. 2 is a cross-sectional view conceptually showing the outline of a main portion of a heat fixing device.

FIG. 2 is a cross-sectional view conceptually showing the outline of a main portion of the heat fixing device 6 in this embodiment. The heat fixing device 6 of this example is an image heating apparatus of the film heating system of the tensionless type using an endless (cylindrical) heat resistant film as disclosed in Japanese Patent Application Laid-open Nos. 4-44075 to 4-44083, 4-204980 to 4-204984, etc.

Reference numeral 21 denotes a slender and thin plate shaped heating. member (a heat source: hereinafter referred to as "heater") which is wholly low in the heat capacity. The specific structure of the heater 1 will be described later.

Reference numeral 22 denotes a film guide member (stay) constituted of an heat insulating material, the cross section thereof being a substantially semi-arcuate downspout type. The heater 21 is inserted and fitted into a heater receiving recess groove portion 22*a* formed at substantially the center portion of a lower surface of the film guide member 22 along a longitudinal direction of the member.

Reference numeral 23 denotes an endless (cylindrical) heat resistant film (hereinafter referred to as "fixing film") that serves as the heating rotary member. The fixing film 23 is loosely attached onto the film guide member 22 to which the heater 21 is fixed as described above with a margin of the peripheral length.

In order to improve the quick start property by lessening the heat capacity, the fixing film 23 is set to 100 $\mu$m or less, preferably 60 $\mu$m or less but 20 $\mu$m or more in total thickness, and is formed of a heat-resistant resin film made of polyimide or PEEK, or a metal film such as Ni electrotyping film or stainless seamless film. In a case of the metal film, because the heat conductivity is excellent, the-metal film can be satisfactorily put in practical use even if its thickness is 15 $\mu$m or less.

In the fixing film 23 used in this embodiment, polyimide varnish is coated on a cylindrical mode and thereafter thermally set, to thereby form a polyimide layer having a given thickness. Then, an adhesive layer is coated on the polyimide layer and PFA powders are electrostatically coated on the adhesive layer, or PFA or PTFE dispersion is coated on the adhesive layer by spray or dipping. Thereafter, baking is made or a PFA tube is coated and melted on the polyimide film, to thereby form a fluorine resin layer having a given thickness as a mold release layer.

Reference numeral 24 denotes an elastic pressure roller as the pressure rotary member which has a silicon rubber layer 24*b* on a core 24*a* made of iron aluminum or the like and a PFA tube layer 24*c* on the silicon rubber layer 24*b* as a mold release layer. More specifically, in manufacturing the pressure roller 24, after the core 24*a* made of iron, aluminum or the like is subjected to surface roughing process such as blasting, it is cleaned. Then, the core 24*a* is inserted into the cylindrical mold and liquid-phase silicon rubber is injected into the mold and thermally set. In this situation, in order to form the resin tube layer 24*c* such as a PFA tube as the mold release layer on the pressure roller surface layer, a tube on an inner surface of which primer has been coated in advance is inserted into the mode, to thereby adhere the tube 24*c* to the rubber layer 24*b* at the same time where the rubber is thermally set. The pressure roller thus molded is subjected to a mold separating process and thereafter secondarily vulcanized.

In the pressure roller 24, both end portions of the core 24*a* are rotatably supported between chassis side plates not shown at a front side and a back side through a bearing. The heater 21 is fitted to an upper side of the pressure roller 24, and the film guide member 22 on which the fixing film 23 is covered faces the heater 21 which is directed downward in such a manner that the fixing film 23 is interposed between the heater 21 and the upper surface of the pressure roller 24. Then, the film guide member 22 is pressedly urged downward against the elasticity of the pressure roller 24 by an urging means not shown, to thereby bring the downward surface of the heater 21 and the pressure roller 24 in press contact with each other with the fixing film 23 interposed therebetween due to a given pressing force to form a fixing nip portion N having a given width.

The pressure roller 24 is rotationally driven at a given peripheral speed in a counterclockwise direction indicated by an arrow by a driving means M. A rotating force is effected on the fixing film 23 due to a pressure contact frictional force exerted at the fixing nip portion N between the outer surface of the roller and the outer surface of the fixing film 23 due to the rotation of the pressure roller 24. As a result, the fixing film 23 is rotationally driven without any corrugation on the outer periphery of the film guide member 22 at substantially the same peripheral speed substantially as the rotating peripheral speed of the pressure roller 24 clockwise as indicated by an arrow while the fixing film 23 is sliding in a state where an inner surface of the fixing film 23 is in close contact with the lower surface of the heater 21, that is, at substantially the same peripheral speed as the feeding speed of the transferring material P on which the non-fixed toner image t fed from the image forming portion side is borne (pressure roller driving system). A lubricant such as grease may be interposed between the outer surface of the film guide member 22 and the inner surface of the fixing film 23 so as to make more smooth the rotation of the fixing film 23.

The pressure roller 24 is driven to bring the fixing film 23 in a rotating state, and electricity is supplied to the heater 21 so that the fixing nip portion N rises up to a given temperature due to heating of the heater 21 and adjust the temperature as will be described later, the transferring material P on which the non-fixed toner image t is borne at the fixing nip portion N between the fixing film 23 and the pressure roller 24, and the toner image bearing surface side of the transferring material P is brought in close contact with the outer surface of the fixing film 23 at the fixing nip portion N, and then nipped and conveyed together with the fixing film 23 at the fixing nip portion N.

In the nipping and conveying process, the heat of the heater 21 is given to the transferring material P through the fixing film 23, and the non-fixed toner image t on the transferring material P is melted by heating and fixed. After the transferring material P has passed through the fixing nip portion N, it is curvature-separated from the outer surface of the rotating fixing film 23 and then conveyed.

(3) Heater 21

Figure 3A:
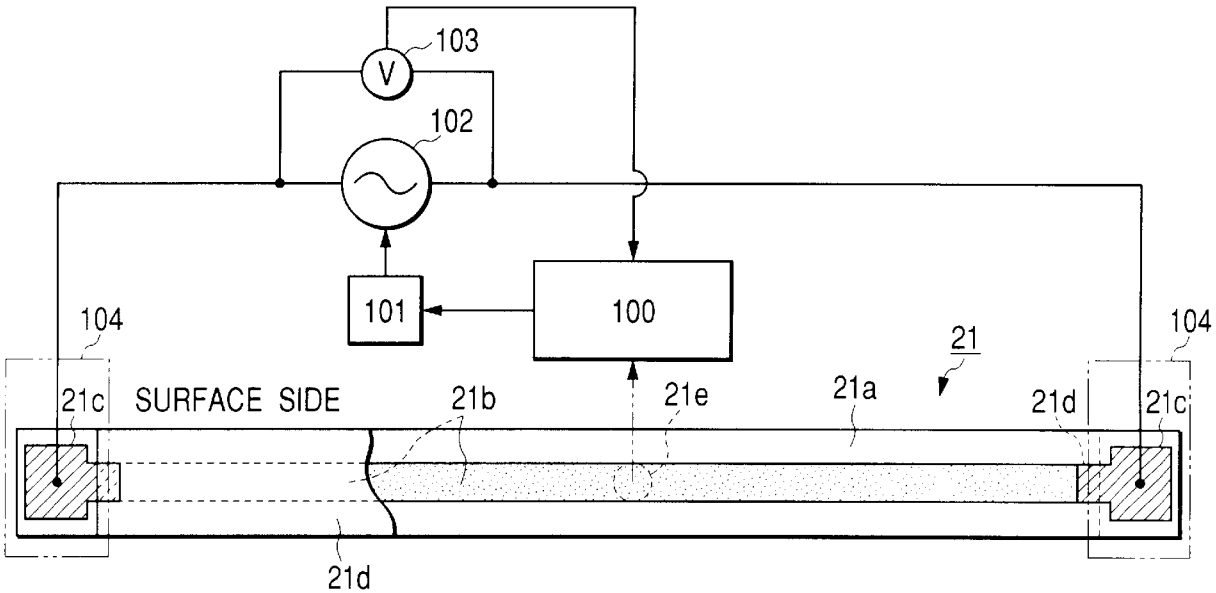
Figure 3B:
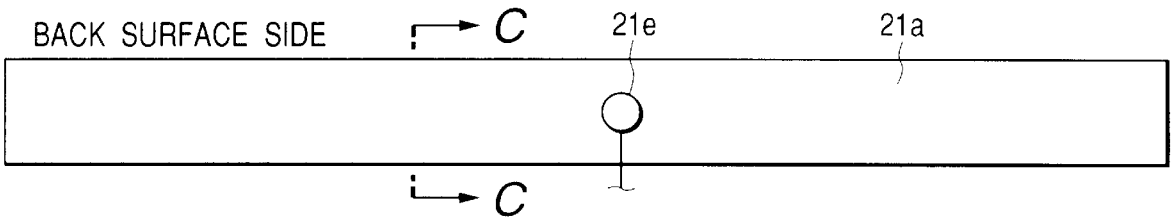
Figure 3C:
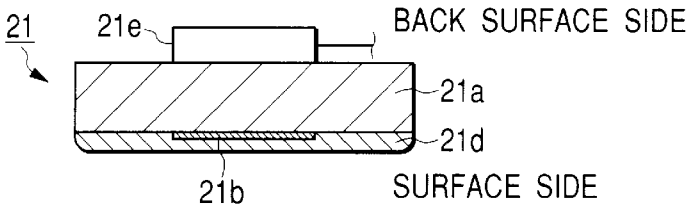

FIG. 3A is a schematically plan view of the partially cut-off surface side of the heater 21 according to this embodiment and a block circuit diagram of an electricity supply system, FIG. 3B is a schematically plan view of the back side of the heater 21, and FIG. 3C is an enlarged schematically laterally cross-sectional view along a line c—c of FIG. 3B.

Reference 21*a* denotes a slender and thin heater substrate longitudinally along a direction substantially orthogonal to the fixing film moving direction (transferring material passing direction). The heater substrate 21*a* is made of a member which is heat resistant, electrically insulating and excellent in heat conductivity and low in the heat capacity, and generally made of a ceramic material such as alumina $Al_2O_3$ or aluminum nitride (AlN).

Reference 21*b* denotes an current heating member (resistant heating member) which is printed into a thick film and has a desired resistance as a heating source that heats by power supply which is equipped at substantially the center portion of the surface side of the heater substrate 21*a* along the longitudinal direction of the substrate. More specifically, the current heating member 21*b* is formed by coating an electric resistant material paste (resistant paste) such as silver-palladium (Ag/Pd) or $Ta_2N$ into a linear or thin band pattern of 10 $\mu$m in thickness and 1 to 3 mm in width through screen printing, and then baking the pattern.

Reference 21*c* positioned at both ends of the heater 21 denote first and second feeding electrode portions equipped on both end surfaces of the front surface side of the heater substrate 21*a*, respectively, which are electrically conductive to the respective end portions of the current heating member 21*b*. Those feeding electrode portions 21*c* are formed by coating an electrically conductive paste such as silver (Ag) into a desired pattern through screen printing and then baking the pattern.

Reference 21*d* denotes an electrically insulating overcoat layer made of glass or the like which entirely coats the heater surface (substrate surface side) except for a part of the feeding electrode portions 21*c* as a surface protective layer and a film sliding layer.

Reference 21*e* denotes a thermistor which is fixed to the back surface of the heater 21 (heater substrate back surface) by adhesive as a temperature detecting element.

Feeding connectors 104 of a feeding circuit are inserted into both end portions of the heater 21, and a voltage is applied between the first and second feeding electrodes 21*c* from the feeding circuit to heat the current heating member 21*b* with the result that the temperature of the heater 21 wholly rapidly rises. The temperature of the heater 21 is monitored by the thermistor 21*e* at the heater back surface side, and its detected temperature information (heater temperature information) is inputted to an engine control portion (control circuit) 100. In order to maintain the temperature of the heater 21 to a given temperature, the engine control portion 100 controls a power supply circuit (a.c. power supply) 102 through the driving circuit (driver) 101 on the basis of the above input heater temperature information and also controls the quantity of feeding to the current heating member 21*b* of the heater 21 from the power supply circuit 102.

Figure 4:
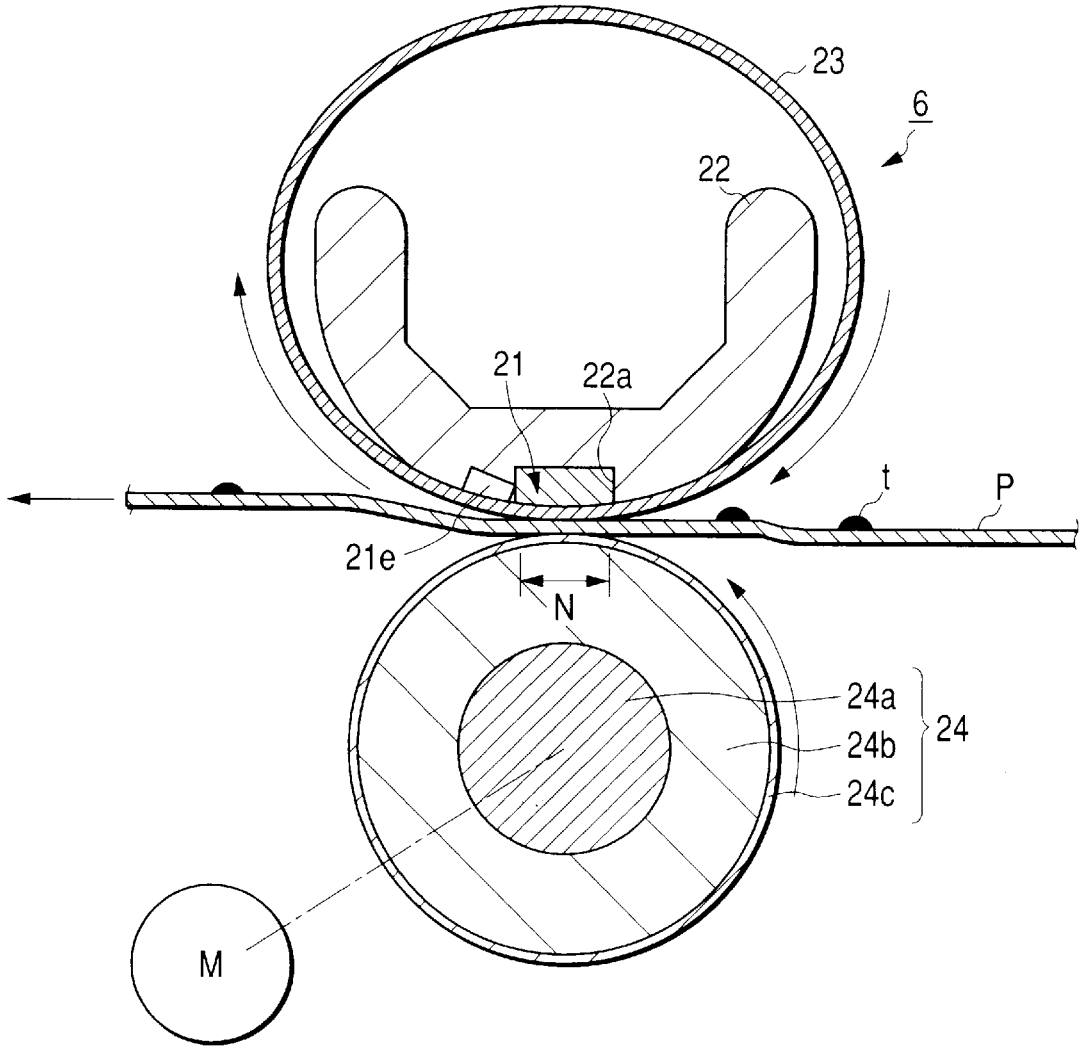
FIG. 4 is a schematically cross-sectional view showing the outline of a main portion of the heat fixing device in which a position at which a temperature detecting element (thermistor) is arranged is changed.

Also, in the case of using a high heat conductive metal film as the fixing film 23, the temperature of the metal film immediately after fixing nipping operation is measured by the thermistor 21*e* so as to control the supply power to the current heating member 21*b* of the heater 21 as shown in FIG. 4.

(4) Control of the Quantity of Current to Heater 21

The quantity of feeding (supply power) to the heater 21 (current heating member 21*b*) is conducted by a known method such as phase control or wave number control on the basis of PI (proportion/integration) control, and at the same time, the engine control portion 100 stores phase angle or wave number information, thereby being capable of being informed of the quantity of electrified power.

In the present specification, the "PI control" is directed to a method of controlling the current duty W' (half-wave number which is electrified when the phase angle at the time of the phase control and, for example, 20 half waves at the time of the wave number control are set as a basic unit) on the basis of the following expression.

$W'=A^*(T0-T)+I$ (the unit is %, and current duty at the time of full current is 100%)

where A is a constant (for example, 5), T0 is a target temperature and T is a thermistor detected temperature which corresponds to P control. I increases the current duty by 5% if the heater temperature monitored every constant period of time (for example, 500 msec) is lower than the target temperature, conversely decreases the current duty by 5% if the monitored temperature is higher than the target temperature. This corresponds to I control.

Figure 5:
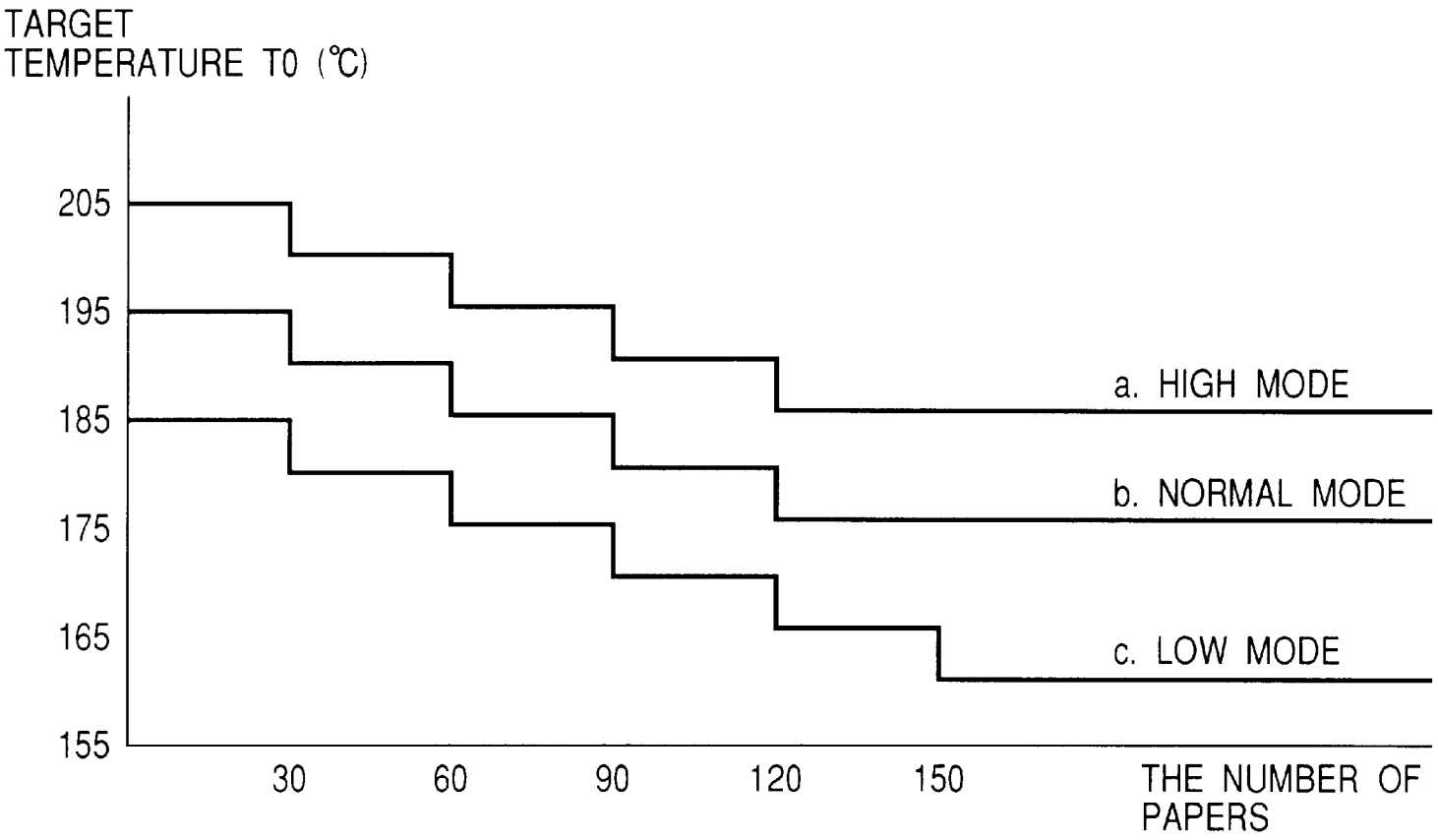
FIG. 5 is a graph showing a fixing control temperature table.

FIG. 5 is a graph showing a heater control temperature table according to this embodiment. In this embodiment, there is applied algorithm that lessens the heater control temperature (target temperature) in accordance with the number of continuous print pages. Because a counter for the number of papers is advanced sheet by sheet every time the number of pages during the continuous printing operation increases one page, a heater control temperature corresponding to the count value of the number-of-papers counter is set. As shown in FIG. 5, the heater control temperature becomes lower as the count value increases. This is because the pressure roller temperature gradually rises during the continuous printing operation with the result that a fixing temperature required for obtaining the sufficient fixing property may be low.

In this embodiment, the number of increased sheets of the number-of-papers counter during intermittent printing operation is set to 10 sheets per one page, and during the intermittent printing operation, when the number-of-papers count for a first page is one sheet, the number-of-papers count for a second page becomes 12 sheets. The count value that increases one by one during the intermittent printing operation may be set to another value. Also, judgment of whether it is the intermittent print or the continuous print is made by measuring a print interval. In this way, the heater temperature can be appropriately controlled in correspondence with the difference between the continuous printing operating and the intermittent printing operation.

In addition, at the time of initial print (a given period of time elapsed after the completion of the previous printing operation), the heater temperature is monitored at the time of starting the printing operation and the number-of-papers counter at the time of start is determined in accordance with that temperature. Specifically, when the heater temperature at the time of printing a first sheet is 85° C. or lower, the number-of-papers counter starts from the set temperature of the first sheet, and when the heater temperature at the time of printing a first sheet is 85° C. or higher, the number-of-papers counter starts from the set temperature of the twenty-first sheet, and thereafter the number-of-papers count increases, for example, 22 sheets, 23 sheets, during the continuous printing operation. Also, when the heater temperature at the time of printing a first sheet is 100° C. or higher, the number-of-papers counter starts from the set temperature of the forty-first, and thereafter the number-of-papers count increases, for example, 42 sheets, 43 sheets, during the continuous printing operation.

In the image forming apparatus according to this embodiment, not only the heater temperature control changes over in accordance with the print interval, but also the heater temperature control changes over in accordance with a mode manually set by a user. In FIG. 5, three lines a, b and c are shown, and the line a is set to a high mode, the line b is set to a normal mode, and the line c is set to a low mode, which are selectable by the user. A default is set to the normal mode of the line b. This is because the kinds of papers used by the user widely range, for example, 60 to 200 g/m$^2$ in basis weight, and therefore even in the case where the temperature control and the power control are conducted at the same time as in the present invention, the provision of only one fixing mode cannot be completely adapted to the temperature control.

In this embodiment, the high mode is set to 135 g/m$^2$ or more in basis weight, the normal mode is set to 60 to 135 g/m$^2$ in basis weight, and the low mode is set to 60 g/m$^2$ or less in basis weight and a fixing temperature corresponding to specific sheets such as an OHP sheet or a coating sheet. As a result, most kinds of paper normally used can be adapted to the normal mode.

Figure 6:
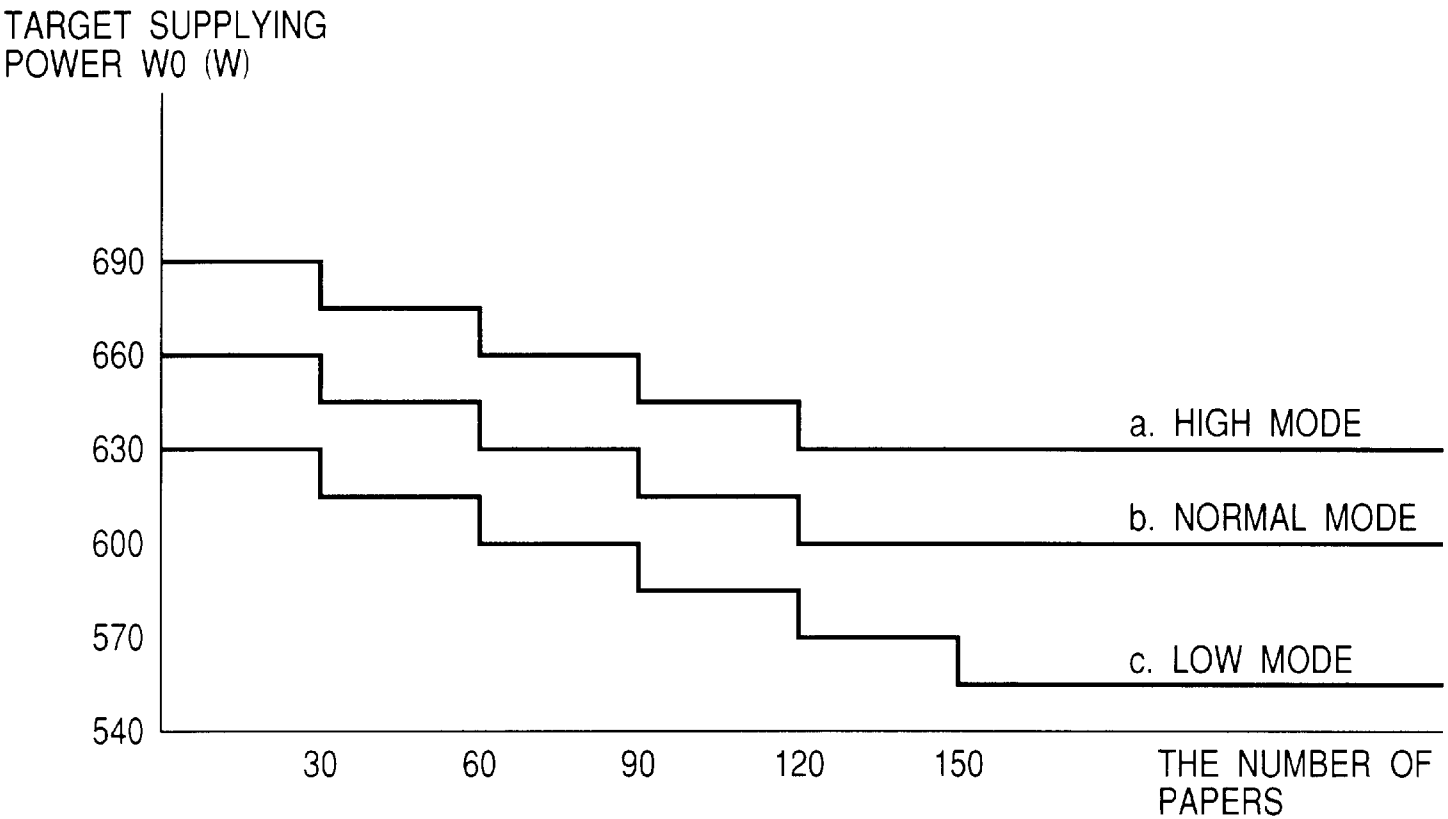
FIG. 6 is a graph showing a supply power table.

FIG. 6 is a graph showing a reference supply power amount table corresponding to the set temperature table shown in FIG. 5. They are values obtained from the supply power required for the respective set temperatures of the representative paper kinds in the respective temperature tables shown in FIG. 5 through the experiment. In FIG. 6, the table corresponds to the number-of-papers count value, but a table may be stored in correspondence with the target temperature.

Subsequently, the operation of this embodiment will be described.

Figure 7:
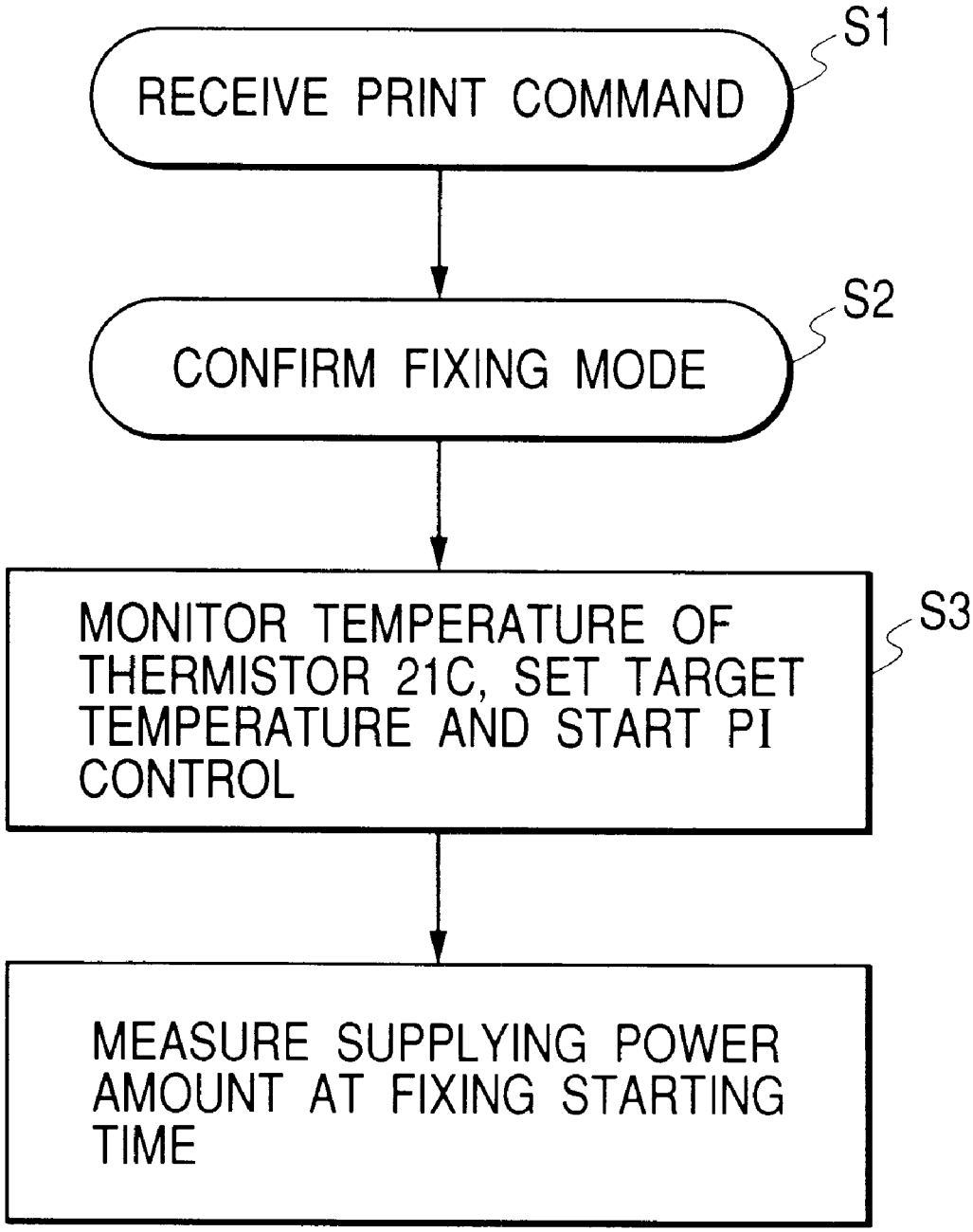
FIG. 7 is a flowchart showing a fixing temperature and supply power control.

FIG. 7 is a flowchart showing a fixing temperature control method in accordance with this embodiment.

After receiving a print command (S1), a set fixing mode (the above a, b and c) and the continuous print or the intermittent print are discriminated (S2). Also, the temperature of the thermistor 21*e* is monitored, and the number-of-papers count value for a first page is determined on the basis of the above values at the time of starting the printing operation, and the target temperature corresponding to the number-of-papers count value is determined with reference to the set temperature table shown in FIG. 5 (S3).

Then, the current duty W' is controlled under the PI control, and a transferring material is fed at such a timing that the transferring material can enter a fixing nip region after the heater temperature reaches the target temperature. After the heater temperature reaches the target temperature, the supply power amount W is monitored for a given period of time (a period of time during which a leading portion of the transferring material is fixed, for example, 100 msec in this embodiment), and its mean value (the mean value of the power amount supplied under the PI control) is obtained. The power amount thus obtained is compared with the reference supply power amount corresponding to the target temperature (the number-of-papers count value) shown in FIG. 6. If a supply voltage is held constant, the above current duty W' has a constant relationship with the power amount. Therefore, in this embodiment, using a relationship W0 (W') between the power amount W0 and the current duty W' at the time of the reference voltage V1 (for example, 100 V), and also using a detected voltage V0 resulting from detecting a voltage value of the supply voltage, the following expression is calculated, and the supply power amount W is monitored.

$$W = W0(W')*(V0/V1)^2$$

As a result, when the supply power amount W is smaller than the reference supply power amount, it is judged that the fixing property is not good because the surface roughness of the transferring material is large, and a contact area between the fixing film and the transferring material is small, and therefore the target temperature is allowed to rise.

Figure 8A:
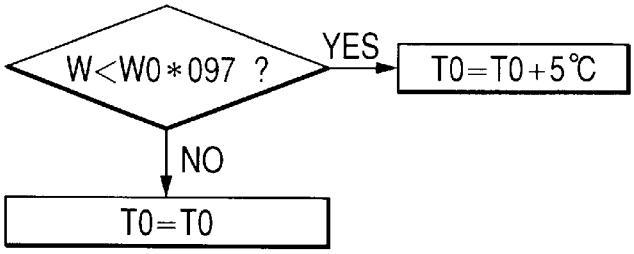
FIG. 8A is a flowchart showing a judging process when a fixing mode is high.
Figure 8B:
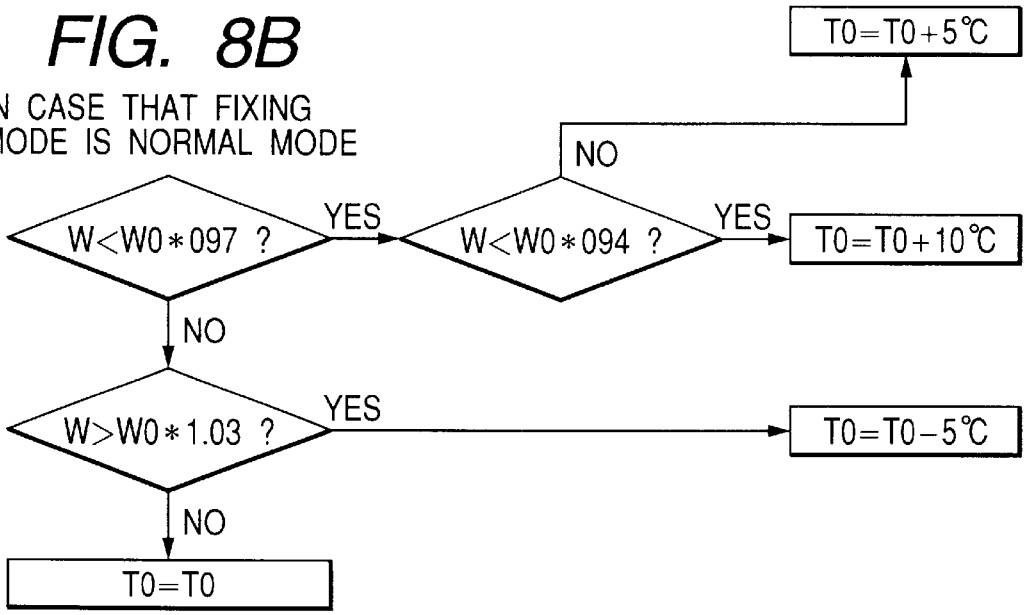
FIG. 8B is a flowchart showing a judging process when the fixing mode is normal.
Figure 8C:
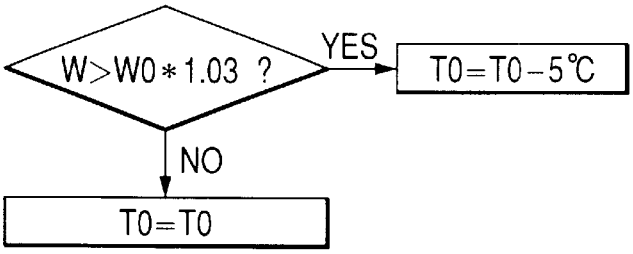
FIG. 8C is a flowchart showing a judging process when the fixing mode is low.

FIGS. 8A to 8C show the judgment references to the target temperature, in which FIG. 8A shows a case in which the fixing mode is high, FIG. 8B shows a case in which the fixing mode is normal and FIG. 8C shows a case in which the fixing mode is low.

Specifically, in the normal mode, if the power amount is different from the reference supply power amount by 3% or more as shown in FIG. 8B, the target control temperature is made to go up and down by 5° C. Further, if the former is different from the latter by 6% or more, the target control temperature is allowed to rise 10° C. only when the supply power amount is lower than the reference supply power amount, and the temperature is set as an upper limit temperature.

As a result, in case of a PPC paper excellent in smoothness (the surface roughness Ra: 3.1 μm, the basis weight 75 g/m$^2$), when fixing is made, for example, at the target control temperature for the first page, because the supply power amount is 670 W which is larger than the reference supply power amount 660 W, no control temperature is changed.

Also, in case of a paper large in the surface roughness which is a so-called "bond paper" (the surface roughness Ra: 4.0 μm, the basis weight 75 g/m$^2$), because the supply power amount under the same conditions is 635 W which is lower than the reference supply power amount 660 W by more than 3%, the control temperature is allowed to rise 5° C.

Further, in case of a paper of the kind larger in the surface roughness which is a so-called "laid paper" (the surface roughness Ra: 4.5 μm, the basis weight 75 g/m$^2$), because the supply power amount is further reduced to 615 W which is lower than the reference supply power amount 660 W by more than 6%, the control temperature is allowed to rise 10° C.

As a result, because an area of the paper of the type large in the surface roughness which is in contact with the fixing film at the fixing nip portion is small, even if there occurs such a phenomenon that a heat current becomes small, the heat capacity sufficient for fixing can be supplied, thereby being capable of preventing the failure of fixing.

In this embodiment, since the heat capacity is supplied from the heater disposed at the nip portion, a correlation between the power supplied to the heater and the heat capacity used for fixing is high, and if the supply power amount is monitored, the heat capacity used for fixing can be recognized at a real time. Therefore, the above-described control is greatly effectively applied to a device that supplies the heat capacity from the heater disposed at the nip portion as in this embodiment as compared with a case in which the control is applied to a heat roller fixing device.

Also, in the high mode, the target control temperature is higher than that in the normal mode by 10° C., and the reference supply power amount is set to 30 W or more. In this mode, the target control temperature is not corrected due to the supply power amount except that the target control temperature is allowed to rise 5° C. only when the supply power amount is lower than the reference supply power amount by 3% or more as shown in FIG. 8A.

This is because this mode is a mode selected by the user for desiring the excellent fixing property, and therefore no correction for lessening the target temperature is conducted so that the heat capacity as large as possible can be supplied to the paper. Also, because a correction for allowing the target temperature to rise has a hot offset limit, the up of 5° C. is an upper limit.

On the other hand, in the low mode, the target control temperature is lower than that in the normal mode by 10° C., and the reference supply power amount is set to 30 W or less. In this mode, the target control temperature is not corrected due to the supply power amount except that the target control temperature is allowed to lessen 5° C. only when the supply power amount is higher than the reference supply power amount by 3% or more as shown in FIG. 8C. This is because this mode is a mode selected by the user so as not to give the heat capacity as large as possible to the paper, and therefore no correction for allowing the target temperature to rise is conducted. Also, because a correction for lessening the target temperature has the limit of fixing failure, the down of 5° C. is a lower limit.

Also, this embodiment is effective in the variation of the fixing nip width in each of the heat fixing devices 6.

a) Specifically, as a result of using a heat fixing device minimum in the fixing nip width (6 mm in an image forming apparatus to which this embodiment is applied) and a heat fixing device maximum in the fixing nip width (8 mm) within the limit of the variations of products, and applying this control to those apparatuses, in the PCC paper excellent in the smoothness (the surface roughness Ra: 3.1 μm, the basis weight 75 g/m$^2$), when fixing is made, for example, at the target control temperature for the first page, because the supply power amount in the fixing apparatus having the minimum nip width is 650 W which is smaller than the reference supply power amount 660 W by 1.5%, no change in the control temperature is made.

On the other hand, because the supply power amount in the heat fixing apparatus having the maximum nip width is 690 W which is larger than the reference supply power amount by 3%, the target control temperature is lessened 5° C.

b) Also, in case of the paper large in the surface roughness which is a so-called "bond paper" (the surface roughness Ra: 4.0 μm, the basis weight 75 g/m$^2$), because the supply power amount under the same conditions in the heat fixing device having the minimum nip width is 615 W which is lower than the reference supply power amount 660 W by more than 6%, the control temperature is allowed to rise 10° C.

On the other hand, because the supply power amount in the heat fixing device having the maximum nip width is 650 W which is smaller than the reference supply power amount by 1.5%, no control temperature is changed.

c) Further, in case of the paper larger in the surface roughness which is a so-called "laid paper" (the surface roughness Ra: 4.5 μm, the basis weight 75 g/m$^2$), because the supply power amount in the heat fixing device having the minimum nip width is 600 W which is lower than the reference supply power amount 660 W by more than 6%, the control temperature is allowed to rise 10° C.

On the other hand, because the supply power amount in the heat fixing device having the maximum nip width is 635 W which is smaller than the reference supply power amount by 3% or more, the control temperature rises 5° C.

Thus, in the heat fixing device narrow in the fixing nip width which makes it difficult to supply the heat capacity to the paper, control is so made as to correct the target temperature to be higher, and in the heat fixing device wide in the fixing nip width which makes it easy to supply the heat capacity to the paper, control is so made as to correct the target control temperature to be lower, thereby being capable of always obtaining the optimum fixing property by absorbing the variation of the respective heat fixing devices.

In this embodiment, because the supply power amount monitored at the leading end of the transferring material, and the target control temperature is variable in accordance with the value of the supply power amount, the heater control temperature automatically rises in the paper of the kind which is rough in the surface property.

Also, although the supply power amount to the transferring material at the time of the fixing operation depends on the thickness of the transferring material, the amount of toner on the transferring material, the amount of humidity absorbed by the transferring material, and the like, but in the study by the present inventors, the large or small supply power amount and the high or low fixing property depend on the surface roughness of the transferring material. For example, in the transferring material (the surface roughness Ra: 2.6 μm, the basis weight 135 g/m$^2$) excellent in the smoothness in which black is printed on the entire surface of a thick paper, as a result of measuring the supply power amount in the same mode as that described above, the power of 720 W is supplied, and the fixing temperature lessens by 5° C. under the control of this embodiment, but the fixing property without any problem was obtained.

On the other hand, in the paper of the kind which is the so-called "laid paper" (the surface roughness Ra: 4.5 μm, the basis weight 75 g/m$^2$), the supply power amount is small, that is, 615 W, and in the case where the fixing temperature is not changed without conducting the control of this embodiment, the toner is liable to be peeled off on the black portion and a half-tone image portion.

Also, the supply power amount in the case of fixing a thin paper high in the smoothness (the surface roughness Ra: 2.7 μm, the basis amount 75 g/m$^2$) is measured in the same m ode as the above mode to be 650 W, and changing of fixing temperature is not performed and no hot offset occurs.

Further, in the case of fixing a thin paper having rough surface property (the surface roughness Ra: 3.8 μm, the basis amount 75 g/m$^2$), the supply power amount is measured in the same mode as the above mode to be 600 W which is smaller than the reference supply power amount by 9%, and control is so made as to allow the fixing temperature to rise by 10° C. However, no hot offset occurs. In this case, if no upper limit is given to the fixing temperature raising amount, an excessive power is supplied to the paper of this kind, resulting in the possibility that the hot offset occurs. However, setting the upper limit enables the fixing within the range which should present no problem in the practical use.

Still further, in this embodiment, since the supply power amount is monitored by the leading end of the transferring material, the supply power amount can be monitored in a region where no toner image is formed in most cases, and it is advantageous in that it is unlikely to be affected by a change in the supply power due to the toner amount.

As described above, in this embodiment, the reference supply power amount is set, and the fixing temperature is made to go up and down due to a difference between the supply power amount and the reference supply power amount. Conversely, it is possible to use a method in which the reference supply power amount is so set as to be adaptive to the paper of the kind which is low in the surface property, and if the supply power amount exceeds the reference supply power amount, the fixing temperature is lowered.

Still further, it is possible to use a method in which the reference supply power amount is so set as to be adaptive to the smooth paper, and if the supply power amount becomes lower than the reference supply power amount, the fixing set temperature is allowed to rise.

Similarly, in those cases, setting an upper limit of the fixing temperature rising amount or dropping amount makes it possible to provide a heat fixing device which should present no practical problem with respect to the transferring material having the basis weight within a constant range.

Also, conversely, in this control, even if there occurs such problems that the fixing property is insufficient or the hot offset occurs, the user can set the mode corresponding to the paper thickness such as the high mode or the low mode, thereby being capable of coping with those problems.

Second Embodiment

Figure 9:
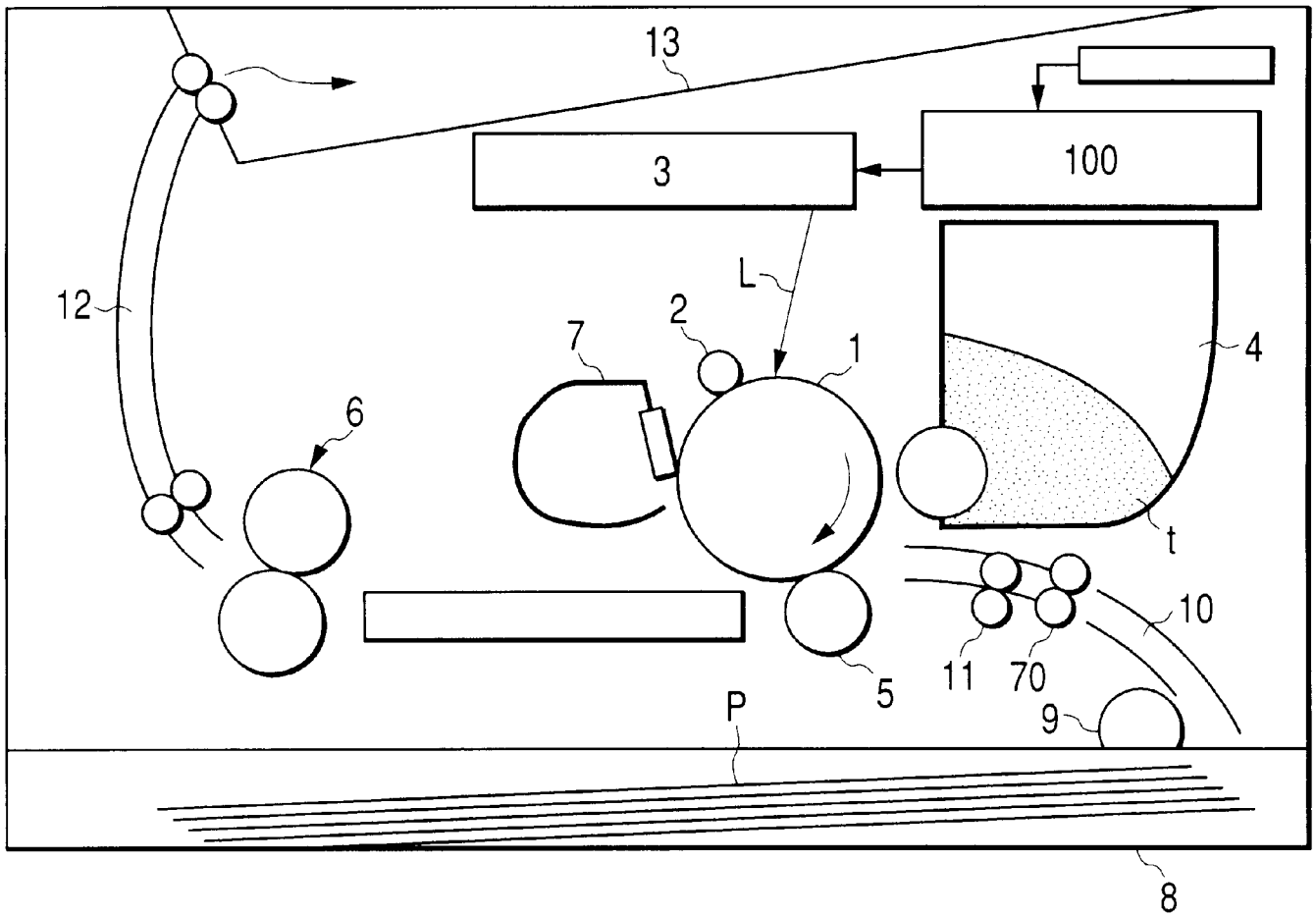
FIG. 9 is a schematic diagram showing the rough structure of an image forming apparatus in accordance with a second embodiment.

FIG. 9 is a schematic diagram showing the rough structure of an image forming apparatus in accordance with this embodiment. The image forming apparatus of this example is directed to a laser beam printer using the transferring electrophotographic process as in the above-described image forming apparatus shown in FIG. 1, and a difference therebetween resides in that the image forming apparatus of this example detects the paper thickness by a paper thickness sensor 70 before the transferring material P enters the heat fixing device 6 and changes the fixing temperature control algorithm in the above first embodiment in accordance with the paper thickness information. The printer structure except for the above is identical with the image forming apparatus shown in FIG. 1, and therefore, the description thereof will be omitted.

The paper thickness sensor 70 is disposed in the sheet path 11 between the sheet feed roller 9 and the registration roller 11.

Figure 10:
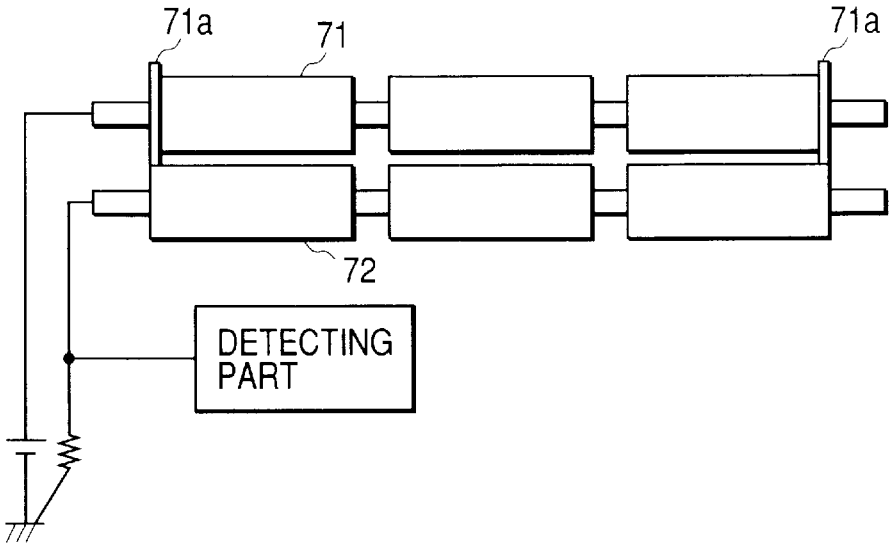
FIG. 10 is an explanatory diagram showing the structure of a paper thickness detecting sensor.

FIG. 10 is a diagram showing the structure of the paper thickness sensor 70 used in this embodiment. In this example, the transferring material passes between a pair of rollers 71 and 72 having a constant gap therebetween, to thereby detect a floating state of flanges 71*a* disposed at both ends of the roller 71 and forming the gap, thus estimating the paper thickness. In this example, those flanges 71*a* operate as electrodes, respectively, and electric conduction between those flanges 71*a* is monitored, to thereby distinguish between a case where the paper thickness is larger than the gap and a case where the paper thickness is smaller than the gap. In this example, the gap is set to 150 μm, and the distinction is made in such a manner that a paper thicker than that gap is a thick paper and a paper thinner than that gap is a normal paper.

Figure 11:
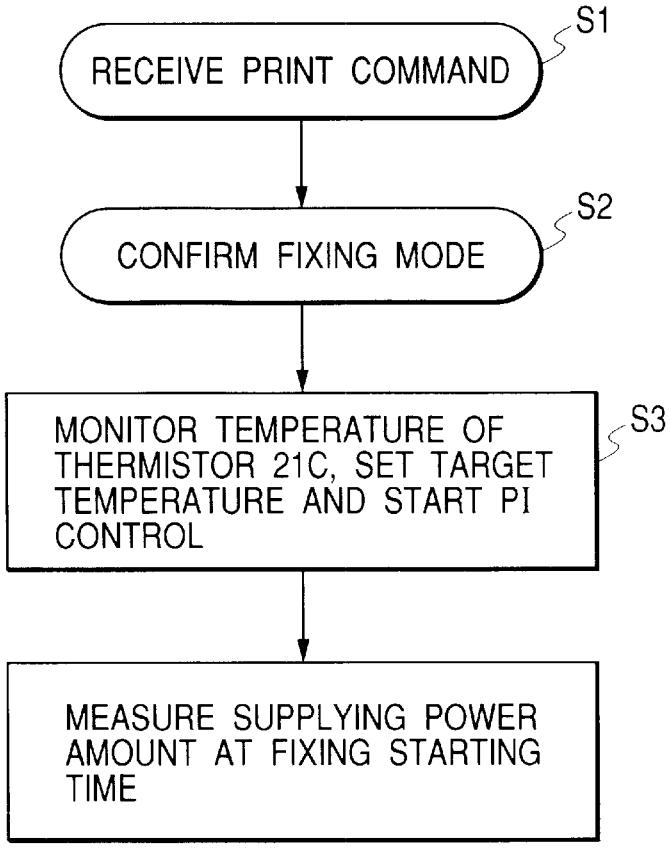
FIG. 11 is a flowchart showing a fixing temperature and supply power control.

FIG. 11 is a flowchart for explaining this embodiment. This control is applied to the laser beam printer identical in conditions with that of the above first embodiment, and the target temperature setting table (FIG. 5) and the reference supply power set table (FIG. 6) are identical with those in the above first embodiment.

After receiving a print command (S1), a set fixing mode (the above a, b and c) and the continuous print or the intermittent print are discriminated (S2). Also, the temperature of the thermistor 21*e* is monitored, and the number-of-papers count value for a first page at the starting time is determined on the basis of the above values, and the target temperature corresponding to the number-of-papers count value is determined with reference to the set temperature table shown in FIG. 5 (S3).

Then, the current duty W' is controlled under the PI control, and a transferring material is fed at such a timing that the transferring material can enter a fixing nip region after the heater temperature reaches the target temperature. After the heater temperature reaches the target temperature, the supply power amount W is monitored for a given period of time (a period of time during which a leading portion of the transferring material is fixed, for example, 100 msec in this embodiment), and its mean value (the mean value of the power amount supplied under the PI control) is obtained. The power amount thus obtained is compared with the reference supply power amount. The reference power amount is different from that in the above-described first embodiment.

That is, in this embodiment, it is judged whether the paper thickness is bigger or smaller than a given value, in accordance with a signal from the paper thickness sensor 70. In the case where it is judged that the paper thickness is bigger than the given value on the basis of the paper thickness detection result, a value which is obtained by increasing the reference supply power amount corresponding to the target temperature in FIG. 6 by a given amount (1.05 times in this example) is used as the reference supply power amount. As a result, when the supply power amount W1 is smaller than the reference supply power amount, it is judged that the fixing property is not excellent because the surface roughness of the transferring material is large, and a contact area of the fixing film and the transferring material is small. Therefore, the target temperature is allowed to rise.

Figure 12A:
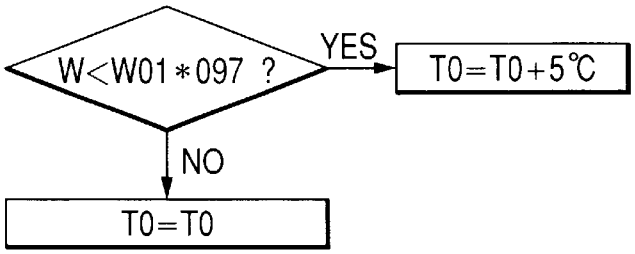
FIG. 12A is a flowchart showing a judging process when a fixing mode is high.
Figure 12B:
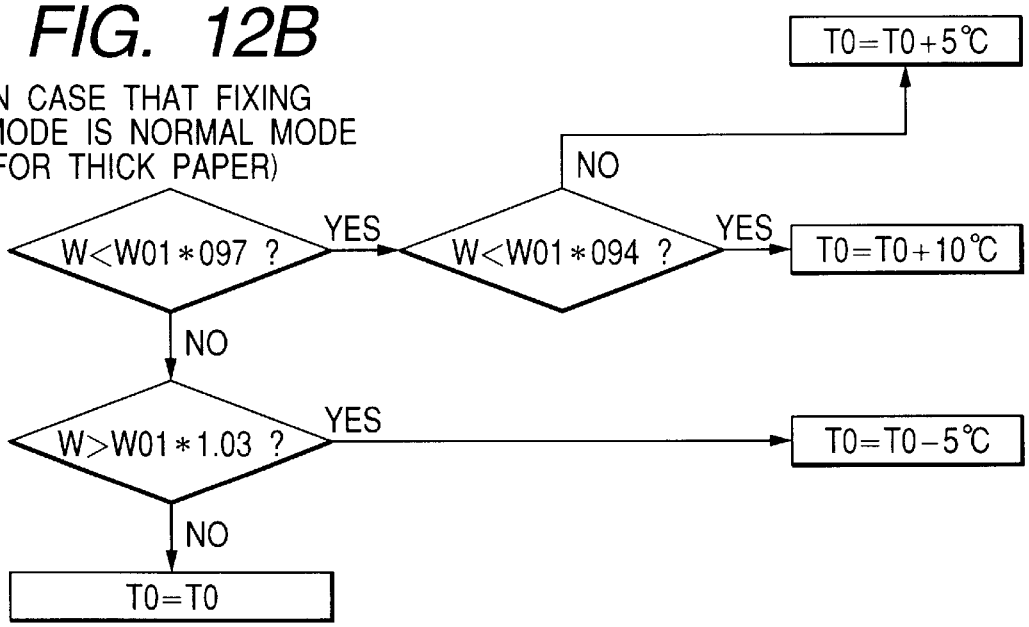
FIG. 12B is a flowchart showing a judging process when the fixing mode is normal.
Figure 12C:
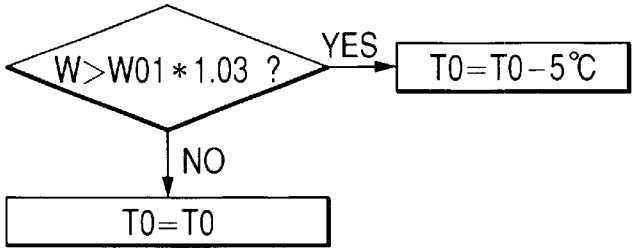
FIG. 12C is a flowchart showing a judging process when the fixing mode is low.

Specifically, as shown in FIGS. 12A to 12C, if the power amount is different from the reference supply power amount by 3% or more, the target control temperature is allowed to go up and down by 5° C. Also, if the difference is greater than 6%, the target control temperature is allowed to rise by 10° C., and this temperature is set as an upper limit temperature.

As a result, in the paper of the kind which is thick and has rough surface property (the surface roughness Ra: 4.2 $\mu$m, the basis weight 135 g/m$^2$, the thickness: 165 $\mu$m), when fixing is made, for example, at the target set temperature for the first page, because the supply power amount is 640 W which is smaller than the reference supply power amount of 693 W (W01) by about 8%, the heater set temperature is raised by 10° C., to thereby obtain a sufficient fixing property.

In this case, in the control of the above first embodiment, in the case of conducting the fixing in the normal mode, because a rise of the fixing temperature is suppressed to 5° C., the transferring material enters a region in which the fixing property is slightly unstable, and in order to ensure the stable fixing property for the paper of this kind, the high mode must be used. In this way, even if the thick paper other than a recommended paper passes, a sufficient fixing property can be obtained even under the normal mode by applying the paper thickness detection together, thereby being capable of providing a heat fixing device excellent in usability.

In the above embodiment, the supply power necessary for maintaining the constant temperature is monitored at the leading portion of the transferring material. Alternatively, a change in temperature when a constant power is supplied may be monitored, or both of the power and temperature may be monitored to correct the target temperature.

Third Embodiment

Since this embodiment is applicable to the laser beam printer as in the above embodiments, the description of that structure will be omitted, and the operation will be described below.

Figure 13:
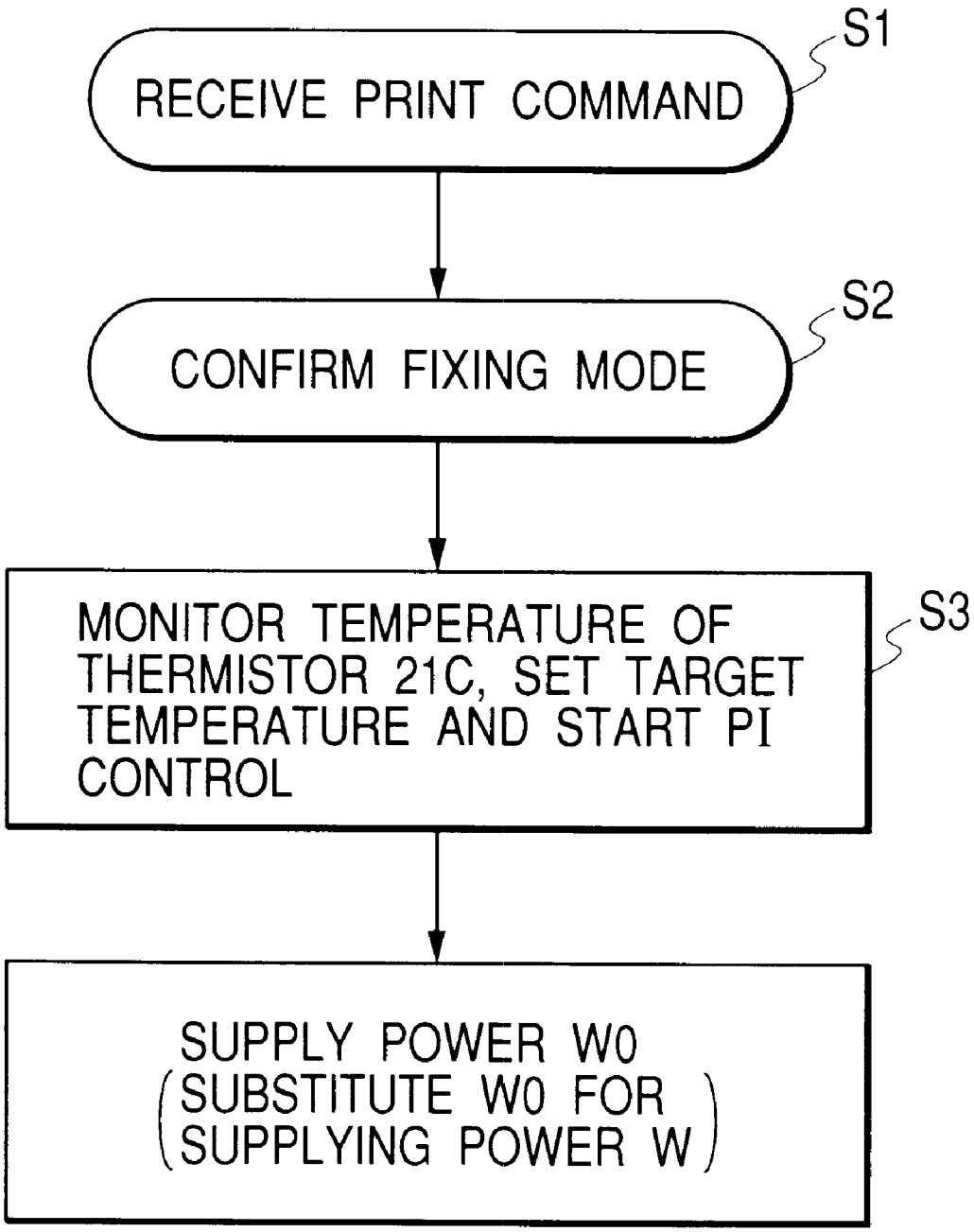
FIG. 13 is a flowchart showing a fixing temperature and supply power control.

FIG. 13 is a flowchart for explaining this embodiment. The target temperature setting stable (FIG. 5) and the reference supply power setting table (FIG. 6) are identical with those in the above embodiments.

After receiving a print command (S1), a set fixing mode (the above a, b and c) and the continuous print or the intermittent print are discriminated (S2). Also, the temperature of the thermistor 21*e* is monitored, and the number-of-papers count value for a first page at the starting time is determined on the basis of the above values, and the target temperature corresponding to the number-of-papers count value is determined with reference to the set temperature table shown in FIG. 5 (S3).

Then, the current duty W' is controlled under the PI control, and a transferring material is fed at such a timing that the transferring material can enter a fixing nip region after the heater temperature reaches the target temperature. After the heater temperature reaches the target temperature, the current control mode is changed over so that the reference power corresponding to the target temperature (the number-of-papers count value) is supplied on the basis of the above reference supply power table at the time when the transferring material enters the fixing nip region. The power amount supplied at this time is supplied by driving the heater at the current duty corrected by the ratio of the supply voltage V0 monitored by the image forming apparatus and the reference voltage V1 as in the above first embodiment. The above reference power may be a reference power corrected in accordance with the detected thickness of the recording material as in the second embodiment.

Thereafter, a constant power continues to be supplied, and the heater temperature is monitored by the thermistor 21*e*. Here, if the heater temperature has changed by a certain amount with respect to the target temperature, the supply power is corrected.

Figure 14A:
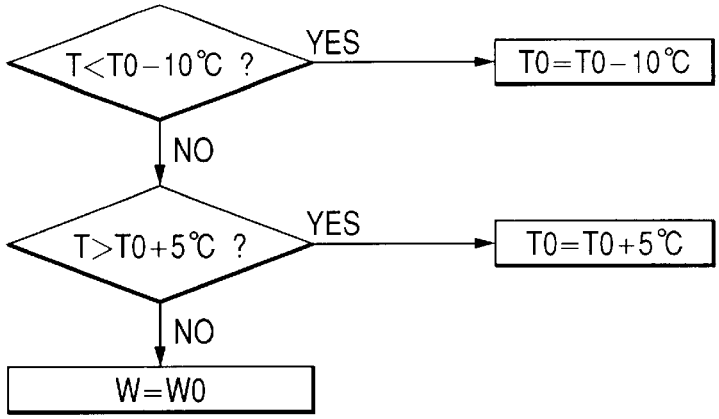
FIG. 14A is a flowchart showing a judging process when a fixing mode is high.
Figure 14B:
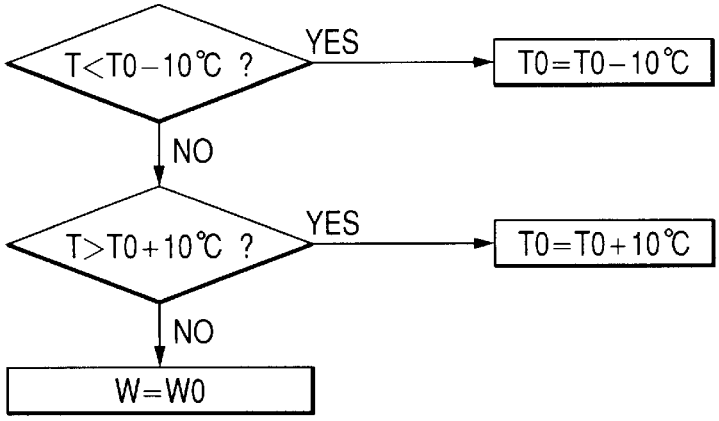
FIG. 14B is a flowchart showing a judging process when the fixing mode is normal.
Figure 14C:
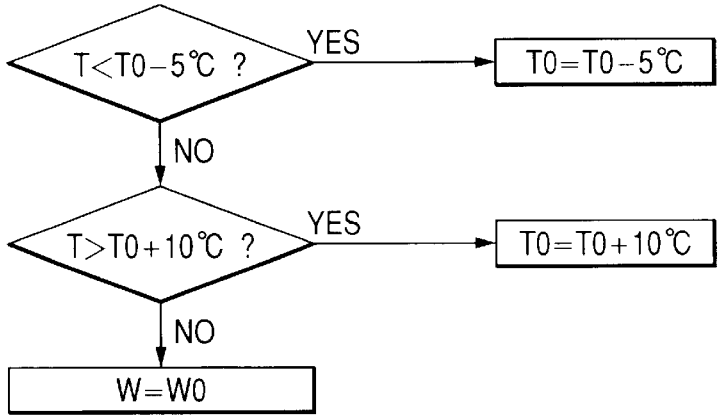
FIG. 14C is a flowchart showing a judging process when the fixing mode is low.

Specifically, as shown in FIGS. 14A to 14C, at the time when the monitor temperature becomes higher than the target temperature by 10° C. (5° C. in the high mode), the PI control is made so that the temperature that is 10° C. (5° C. in the high mode) higher than the target temperature is maintained. Similarly,at the time when the monitor temperature becomes lower than the target temperature by 10° C. (5° C. in the low mode), the PI control is made so that the temperature that is 10° C. (5° C. in the low mode) lower than the target temperature is maintained.

This control allows the heater control temperature to automatically drop because the supply power amount is held constant with respect to the paper of the kind excellent in the smoothness as in the above first embodiment, whereas it allows the heater control temperature to automatically rise with respect to the paper of the kind rough in the surface property, thereby being capable of eliminating problems such as curling or hot offset while maintaining the excellent fixing property in accordance with kind of paper used.

Also, in the case of fixing a pattern high in the printing ratio such as solid black on a thick paper excellent in the smoothness by changing over from the constant power supply control to control under which the heater temperature is held constant if, on the basis of the heater temperature monitoring result, it is found that the heater temperature deviates from the target temperature by more than a certain value or more, the power supply is liable to increase. Therefore, the heater temperature dropping amount is liable to increase under simple constant power control, and there may be a fear that the fixing property is degraded due to the increase in the heater temperature lessening amount. However, the application of the algorithm according to this control enables such drawback to be suppressed to the minimum.

Similarly, in the paper of the kind which is thin and rough in the surface smoothness, because less power is consumed conversely, the heater temperature rising amount is liable to increase under the simple constant power control, and there may be a fear that the hot offset occurs due to the increase in the heater temperature rising amount. However, the application of the algorithm according to this control enables such drawback to be suppressed to the minimum.

In addition, if the paper thickness detection described in the above second embodiment is applied to the control method of this embodiment, the control precision is improved.

The above description is given of the embodiments of the heat fixing device, but the present invention can also be effectively applied to an image heating apparatus that heats a non-fixed image on the recording material to provisionally fix the image or heats an image on the recording material to change the surface property such as enamel, and an image forming apparatus having the image heating apparatus.

Also, the heating member (heater) 21 is not limited to the ceramic heater, but an electromagnetic induction heat generating member such as an iron plate, for example, may also be used.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image heating apparatus, comprising:

temperature detecting means for detecting a temperature of at least one of a heating member and a heating rotary member;

current control means for controlling current to the heating member so that the temperature detected by said temperature detecting means reaches a target temperature;

power monitoring means for monitoring a necessary amount of electric power to keep the target temperature, the electric power being supplied to said heating member; and correcting means for correcting the target temperature on the basis of the monitoring result by said power monitoring means.

2. An image heating apparatus according to claim 1, wherein the heating rotary member slides on an inner surface of said heating member; and, further comprising a pressure rotary member that forms a nip portion in association with the heating member through the heating rotary member;

wherein a recording material that bears an image is nipped and conveyed between said heating rotary member and said pressure rotary member to heat the image on the recording material due to a heat from the heating member through the heating rotary member.

3. An image heating apparatus according to claim 1, wherein said correcting means includes detecting means for detecting the thickness of a transferring material and corrects the target temperature in accordance with the detected thickness.

4. An image heating apparatus according to claim 1, further comprising means for setting said target temperature in accordance with a number of continuously passing sheets and intervals of passing sheets or an operation mode set by an operator.

5. An image heating apparatus according to claim 1, wherein the heating rotary member is made of a flexible thin endless film which is 20 to 150 $\mu$m in thickness and has a mold release layer formed on the surface thereof.

6. An image heating apparatus according to claim 1, wherein said power monitoring means monitors the amount of electric power supplied to said heating member when a leading portion of the recording material is heated.

7. An image heating apparatus according to claim 1, wherein said power monitoring means monitors the amount of electric power supplied to said heating member in a state where a detected temperature is maintained in the vicinity of the target temperature.

8. An image heating apparatus according to claim 1, wherein said current control means controls the current to the heating member by a phase angle or wave number so that the temperature detected by said temperature detecting means becomes the target temperature.

9. An image forming apparatus including image forming means for forming an image on a recording material; a heating rotary member which slides while an inner surface of said heating rotary member is in contact with the heating member; and a pressure rotary member that forms a nip portion in association with the heating member through the heating rotary member; wherein a recording material that bears an image is nipped and conveyed between said heating rotary member and said pressure rotary member to fix the image on the recording material due to heat from the heating member through the heating rotary member, said image forming apparatus comprising:

temperature detecting means for detecting the temperature of at least one of a heating member and a heating rotary member;

current control means for controlling current to the heating member so that the temperature detected by said temperature detecting means reaches a target temperature;

power monitoring means for monitoring a necessary amount of electric power to keep the target temperature, the electric power being supplied to said heating member; and correcting means for correcting the target temperature on the basis of the monitoring result by said power monitoring means.

10. An image forming apparatus according to claim 9, wherein said correcting means includes detecting means for detecting the thickness of a recording material and corrects the target temperature in accordance with the detected thickness.

11. An image heating apparatus, comprising:

temperature detecting means for detecting the temperature of at least one of a heating member and a heating rotary member; and current control means for controlling the current to said heating member;

wherein said current control means has a first current control mode that controls the current to the heating member so that a constant power is supplied to the heating member if the temperature detected by said temperature detecting means is within a given range during a fixing operation.

12. An image heating apparatus according to claim 11, further comprising a heating rotary member which slides while an inner surface of said heating rotary member is in contact with the heating member; and a pressure rotary member that forms a nip portion in association with the heating member through the heating rotary member; wherein a recording material that bears an image is nipped and conveyed between said heating rotary member and said pressure rotary member to heat the image on the recording material due to a heat from the heating member through the heating rotary member.

13. An image heating apparatus according to claim 11, further comprising detecting means for detecting the thickness of a recording material, and wherein said current means control means controls current to the heating member in accordance with the detected thickness.

14. An image heating apparatus according to claim 11, wherein said current control means further has a second current control mode that controls the current to the heating member so that the temperature detected by said temperature detecting means becomes the target temperature.

15. An image heating apparatus according to claim 14, further comprising means for setting said target temperature in accordance with the number of continuously passing sheets and intervals of passing sheets or an operation mode set by an operator.

16. An image heating apparatus according to claim 14, wherein said current control means controls the current to the heating member by a phase angle or wave number.

17. An image heating apparatus according to claim 14, wherein said current control means controls the current to the heating member by changing over from the first current control mode to the second current control mode if the temperature detected by said temperature detecting means in the first current control mode is out of the given range.

18. An image heating apparatus according to claim 11, wherein the heating rotary member comprises a flexible thin endless film which is 20 to 150 $\mu$m in thickness and has a mold release layer formed on the surface thereof.

19. An image forming apparatus including image forming means for forming an image on a recording material; a heating rotary member which slides while an inner surface of said heating rotary member is in contact with the heating member; and a pressure rotary member that forms a nip portion in association with the heating member through the heating rotary member; wherein a recording material that bears an image is nipped and conveyed between said heating rotary member and said pressure rotary member to fix the image on the recording material due to a heat from the heating member through the heating rotary member, said image forming apparatus comprising:

temperature detecting means for detecting the temperature of at least one of a heating member and a heating rotary member; and current control means for controlling current to the heating member;

wherein said current control means has a first current control mode that controls the current to the heating member so that a constant power is supplied to the heating member if the temperature detected by said temperature detecting means is within a given range during a fixing operation.

20. An image forming apparatus according to claim 19, wherein said current control means further has a second current control mode that controls the current to the heating member so that the temperature detected by said temperature detecting means becomes the target temperature, and controls the current to the heating member by changing over from the first current control mode to the second current control mode if the temperature detected by said temperature detecting means in the first current control mode is out of the given range.

* * * * *

UNITED STATES PATENT AND TRADEMARK OFFICE

CERTIFICATE OF CORRECTION

PATENT NO. : 6,519,426 B2
DATED : February 11, 2003
INVENTOR(S) : Masahiro Goto et al.

It is certified that error appears in the above-identified patent and that said Letters Patent is hereby corrected as shown below:

Column 1,
Line 9, “born” should read -- borne --.
Line 21, “i s” should read -- is --.
Line 67, “the” (2nd occurrence) should be deleted.

Column 4,
Line 2, “member;” should read -- member --.

Column 7,
Line 19, “from” should read -- form --.
Line 39, “the a” should read -- a --.

Column 8,
Line 6, “an” should read -- a --.
Line 24, “the-metal” should read -- the metal --.
Line 39, “iron” should read -- iron, --.

Column 9,
Lines 45 and 50, “schematically” should read -- schematic --.
Line 60, “an” should read -- a --.

Column 15,
Line 15, “m” should read -- mode --.
Line 16, “ode” should be deleted.

Column 18,
Line 21, “Similarly,at” should read -- Similarly, at --.

Column 19,
Line 39, “comprising” should read -- comprising: --.

UNITED STATES PATENT AND TRADEMARK OFFICE

CERTIFICATE OF CORRECTION

PATENT NO. : 6,519,426 B2
DATED : February 11, 2003
INVENTOR(S) : Masahiro Goto et al.

It is certified that error appears in the above-identified patent and that said Letters Patent is hereby corrected as shown below:

Column 20,
Line 65, "current means" should read -- current --.

Signed and Sealed this

Fourteenth Day of October, 2003

JAMES E. ROGAN
*Director of the United States Patent and Trademark Office*